US009216843B2

(12) United States Patent
Sorensen et al.

(10) Patent No.: US 9,216,843 B2
(45) Date of Patent: Dec. 22, 2015

(54) STACKABLE CONTAINER SYSTEM

(71) Applicant: Runway Blue, LLC, Lehi, UT (US)

(72) Inventors: Steven M. Sorensen, Alpine, UT (US); Kim L. Sorensen, Alpine, UT (US); David O. Meyers, Kaysville, UT (US)

(73) Assignee: RUNWAY BLUE, LLC, Lehi, UT (US)

( * ) Notice: Subject to any disclaimer, the term of this patent is extended or adjusted under 35 U.S.C. 154(b) by 0 days.

(21) Appl. No.: 14/297,433

(22) Filed: Jun. 5, 2014

(65) Prior Publication Data

US 2014/0360908 A1 Dec. 11, 2014

Related U.S. Application Data

(60) Provisional application No. 61/832,085, filed on Jun. 6, 2013, provisional application No. 61/873,334, filed on Sep. 3, 2013.

(51) Int. Cl.

| | |
|---|---|
| ***B65D 21/036*** | (2006.01) |
| ***B65D 21/02*** | (2006.01) |
| ***B65D 81/32*** | (2006.01) |
| ***B65D 47/08*** | (2006.01) |
| ***B65D 51/24*** | (2006.01) |
| ***B65D 51/28*** | (2006.01) |

(52) U.S. Cl.

CPC ..... *B65D 21/0228* (2013.01); *B65D 47/0895* (2013.01); *B65D 51/242* (2013.01); *B65D 51/28* (2013.01); *B65D 81/3205* (2013.01); *B65D 21/0219* (2013.01)

(58) Field of Classification Search

CPC ..... B65D 21/0228; B65D 21/023; B65D 21/022; B65D 21/0219; B65D 21/0223; B65D 21/0217; B65D 21/0209; B65D 21/02; B65D 47/0895; B65D 51/28; B65D 51/242; B65D 51/24; B65D 81/3205; Y10S 206/821

USPC ..... 215/6, 10; 220/522, 4.27; 206/501, 821

See application file for complete search history.

(56) References Cited

U.S. PATENT DOCUMENTS

| | | | | |
|---|---|---|---|---|
| 2,326,414 | A | 8/1943 | Thompson | |
| 2,488,611 | A * | 11/1949 | Stallings | 215/10 |
| 2,514,573 | A * | 7/1950 | Harrison | 220/4.24 |
| 2,595,113 | A * | 4/1952 | Taberer | 220/4.27 |
| 3,143,205 | A | 8/1964 | Ruderian | |
| 3,369,691 | A | 2/1968 | Wei | |
| 4,720,351 | A * | 1/1988 | Flynn et al. | 510/277 |
| 5,865,353 | A * | 2/1999 | Baudin | 222/546 |

(Continued)

OTHER PUBLICATIONS

U.S. Appl. No. 13/633,864, filed Oct. 2, 2012, Sorensen, et al.

(Continued)

*Primary Examiner* — Stephen Castellano
(74) *Attorney, Agent, or Firm* — Maschoff Brennan

(57) ABSTRACT

A stackable container system may comprise a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids. In addition to storing beverage ingredients, the stackable container system can also be used to store other edible and inedible ingredients.

20 Claims, 12 Drawing Sheets

(56) References Cited

U.S. PATENT DOCUMENTS

| | | | |
|---|---|---|---|
| 6,379,032 | B1 | 4/2002 | Sorensen |
| D510,235 | S | 10/2005 | Sorensen |
| D626,837 | S | 11/2010 | Meyers et al. |
| D626,838 | S | 11/2010 | Meyers et al. |
| 8,342,349 | B2 | 1/2013 | Lu |
| D696,551 | S | 12/2013 | Meyers et al. |
| D697,798 | S | 1/2014 | Sorensen et al. |
| 8,695,830 | B2 | 4/2014 | Meyers et al. |
| 8,833,586 | B2 | 9/2014 | Meyers et al. |
| 2007/0012693 | A1 * | 1/2007 | Kummer ..... 220/4.27 |
| 2009/0188884 | A1 * | 7/2009 | Nelson et al. ..... 215/6 |
| 2010/0176022 | A1 | 7/2010 | Furlong |

OTHER PUBLICATIONS

International Search Report and Written Opinion from PCT/US2014/041333 dated Oct. 24, 2014.

* cited by examiner

STACKABLE CONTAINER SYSTEM

CROSS-REFERENCE TO RELATED APPLICATIONS

The present application claims priority to and the benefit of U.S. Provisional Patent Application Ser. No. 61/832,085, entitled STACKABLE CONTAINER SYSTEM, which was filed on Jun. 6, 2013; and U.S. Provisional Patent Application Ser. No. 61/873,334, entitled STACKABLE CONTAINER SYSTEM, which was filed on Sep. 3, 2013; each of which is hereby incorporated by reference in its entirety.

BACKGROUND

1. Field of the Invention

The present invention generally related to containers and, in particular, to containers that can be connected together such as in a stack.

2. Description of Related Art

Beverage bottles or containers have become widely used. Such containers are often used to carry liquids, such as water and juices, and powders, which may include proteins and vitamins. The containers may also be used to mix ingredients. For example, many people use these containers to mix nutritional powders into water or another liquid for consumption in conjunction with exercise.

It is often desirable to delay the mixing of the ingredients until an appropriate time. Because such containers are often used on-the-go, it can be difficult to separately maintain the ingredients until the desired time. For example, some may use multiple containers to store the ingredients of a protein shake until after a workout is finished. The contents of the containers may then be mixed to make the protein shake. Similarly, one or more separate containers may also be used to store supplements, such as vitamins or other pills, which are not mixed in the container. Therefore, a number of containers may have to be tracked and transported.

Keeping track of multiple containers can be burdensome. It can also be difficult to carry and transport multiple containers. To address this, some beverage containers have been developed that arc configured to allow one or more additional containers to be attached to the beverage container. The additional containers can be used to store ingredients to be mixed in the beverage container at a later time, or to separately store other contents such as pills.

BRIEF SUMMARY OF THE INVENTION

A need therefore exists for a system which eliminates the above-described disadvantages and problems.

One aspect is a system that may contain one or more containers and the containers may be connected to form a stack. The stackable container system can include any suitable number of containers including one, two, three or more. The containers are preferably stackable and at least two containers may be used to create a stack. Advantageously, one or more of the containers may be interchangeable, which may allow the containers to be swapped and/or switched as desired or needed. The containers may also have different shapes and/or sizes, and this may increase the potential uses of the stackable container system. Significantly, the stackable container system may allow a plurality of items to be conveniently stored until needed. For instance, the stackable container system may be used to store one or more liquids, beverages, drinks and the like. In particular, the stackable container system may be used to hold fluids such as water or juices. The stackable container system may also be used to store one or more ingredients, mixes, solids, foodstuffs, etc. The stackable container may facilitate mixing of two or more items to create combinations and/or blends such as shakes, protein drinks, thirst-quenchers, infusions and the like. Thus, the stackable container may be used for storing liquids and/or solids, and these items may be mixed and/or stored independently.

Another aspect is a stackable container system that may comprise a first container, which may be a primary container and/or a beverage container, and a lid for the first container. The stackable container system may also include a plurality of secondary containers and these secondary containers may be smaller than the first container. The secondary or smaller containers may include a lid to create individual compartments or containers. The smaller containers and smaller container lids may be configured to allow any of the smaller container lids to be used in connection with any of the smaller containers. In addition, the bottom of the beverage container and the bottom of the smaller containers may be sized and configured to allow the beverage container and/or the smaller containers to be connected to any of the smaller container lids.

Still another aspect is a stackable container system that may comprise a beverage container, a beverage container lid, a plurality of smaller containers, a plurality of smaller container lids, and one or more trays or dividers that may be sized and configured to be disposed inside at least one of the containers. For example, the divider can be inserted into one or more of the plurality of smaller containers. Advantageously, the divider may be disposed in one of the smaller containers when a lid is attached to the smaller container. The smaller containers and smaller container lids may be configured to allow any of the smaller container lids to be used in connection with any of the smaller containers. The bottom of the beverage container and the bottom of each smaller container may also be configured to allow the beverage container or smaller container to be connected, interlocked or coupled to any of the smaller container lids.

Still yet another aspect is a stackable a container system that may comprise a larger container, a larger container lid, a plurality of smaller containers, and a plurality of smaller container lids. The bottom of each of the containers may be configured to allow the container to be connected, interlocked, or coupled to a top portion of any of the at least one smaller container lids when the smaller container lid is secured to one of the smaller containers.

A further aspect is a stackable container system that may include a tray, divider or portion that can be attached to a lid. For example, the tray may be attached to an inner surface of a lid and the lid can preferably still be attached to any suitable container. The tray may include one or more compartments, sections or parts, which may be sized and configured to receive and/or hold items such as pills, vitamins, supplements, powders, medicines and the like. The tray may be sized and configured to received liquids and/or solids depending, for example, upon the intended use of the stackable container system. The tray may be removably or permanently connected depending, for instance, upon the intended use of the container.

Another further aspect is a stackable container system that may include one or more sections or portions which may be intended to help keep items hot and/or cold. For example, the container system may include a tray or disc that may be removably or permanently attached to a lower portion of a lid. The tray could include materials intended to retain and/or transfer heat and/or cold so that other materials or portions of the container may be heated or cooled as desired. For instance, the tray could include gel packs or other materials that can be heated or cooled and then the accompanying container may also be heated or cooled. That may allow, for instance, the tray to be heated in a microwave or oven, or cooled in a freezer or ice, and then it may be used to help maintain liquids and/or solids in the container at a desired temperature.

Still another further aspect is a stackable container system in which the materials in the containers may be kept at a desired temperature. For example, a tray could be attached to an inner surface of the lid and the tray may be heated or cooled to help maintain the desired temperature. Alternatively, items may be added and/or removed from the tray to help maintain the desired temperature.

Another aspect is a stackable container system that may include a first container, which may be a primary or main container. The primary container may hold liquids such as beverages, fluids, water, juices, drinks and the like. The primary container, which may also be referred to as a beverage container, may include a lid with an opening and a flip-top closure. In particular, the beverage container lid may include an opening or spout that allows liquids or mixtures to be poured or otherwise consumed. The beverage container lid may also allow a user to drink from the opening. The flip-top closure preferably selectively closes and/or seals the opening to prevent the flow of liquids or mixtures through the opening. The beverage container lid may be connected to the primary container by a first connecting mechanism such as a screw-type or threaded connection. The base of the beverage container lid may include a second connecting mechanism, such as a twist and lock or bayonet-type connection, which may allow one or more secondary containers to be selectively attached to the primary container.

Still another aspect is a stackable container system that may include a primary container and a plurality of secondary containers, which may also be referred to as smaller containers. The secondary containers may be fully independent and may be usable separately from the primary container. The primary container may also be used separately and independently from the secondary containers. In greater detail, the primary and/or secondary containers may include a lid, and the lid may be used to create an airtight and/or watertight compartment, which may allow the containers to be used alone, independently or autonomously. The secondary containers may be used in combination with other secondary containers and/or a primary container. For example, a secondary container may be attached to one or more secondary containers to form at least a portion of a stack. Advantageously, the secondary containers may be connected in any desired order or arrangement, and the secondary containers may offer unlimited expandability. In addition, any of the secondary containers may be attached to a primary container. Therefore, the stackable container system may be expandable and used in a number of suitable configurations and arrangements.

Still yet another aspect is a stackable container system that may include smaller or secondary container lids that can be interchangeably attached to any of the smaller containers and/or primary container. Preferably, the smaller container lid includes a first connecting mechanism that allows the lid to be connected to the primary container or a secondary container. In particular, a first connecting mechanism of the secondary container lid may be connected to a base of a primary container or a base of a secondary container. Significantly, the first connecting mechanism of the second container lid may allow the lid to be selectively attached to a primary container or a secondary container, which may significantly increase the potential uses of the stackable container system. The smaller container lid may also include a second connecting mechanism that allows the lid to be interchangeably connected to a smaller container. The second connecting mechanism, which may be a threaded connection, may allow the lid to be selectively connected to an upper portion of a small container. Advantageously, if the smaller container lid can be connected to any container, that may allow the lids and/or containers to be exchanged, switched and swapped as desired. This may also allow the lids and/or containers to be connected in various configurations and arrangements.

A further aspect is stackable container system that may include a tray that can be connected to a smaller container lid. For example, the tray, which may be sized and configured to hold items such as pills, medicine, powders, vitamins and the like, may be connected to an upper, inner surface of the lid and the tray may be independently connected to the lid. This may allow the container to be used with or without the lid. If the tray is connected to the upper, inner surface of the lid, the lid may be selectively connected to the container whether or not the tray is connected to the lid. The tray may be conveniently connected to the lid by inserting an outer edge or perimeter of the tray into a receiving portion and then turning the tray and/or lid to connect the tray and the lid.

The stackable container system may beneficially provide a leak-proof, expandable storage system that allows various items to be conveniently stored, transported mixed and/or consumed. The primary container, which may be sized and configured to hold liquids and may include a lid with an opening and a flip top cap, may be selectively connected to one or more smaller containers. For instance, the primary container may hold water, flavored drink mixes, sports drinks, electrolyte and/or supplement mixes, energy drinks, juices, and other types of beverages. The secondary containers may include fluids, mixes, powders, foodstuffs and the like, which may be mixed with the contents of the primary container to make protein shakes, nutrition drinks, meal replacement drinks, and the like. The secondary containers may also include items that are used separately and/or independently from the primary container such as fruits, snacks, protein packs, etc. Significantly, the primary and secondary containers may have various shapes and sizes depending, for example, upon the intended use of the stackable container system. For example, the secondary containers may have a smaller size for carrying protein powders, vitamins, and other materials that are intended to be mixed or blended with the contents of the primary container. On the other hand, the secondary containers may be larger (collectively or individually) if the containers are intended to contain snacks, energy bars, energy gels, protein bars and the like. Depending upon the intended use of the stackable container system, the contents of the various containers may be used separately or in combination.

Advantageously, the stackable container system may be portable and versatile. The containers and container system may also be durable, resilient and long-lasting. Because the containers may seal tightly, the containers may be leak and spill-proof. The containers may also be airtight and/or watertight. Significantly, the stackable container system may allow liquids, powders, vitamins, supplements, snacks and more to be easily and conveniently carried. In addition, because the same lid may be used to seal a secondary container and allow that container to be attached to another secondary container or a primary container, a multipurpose system may be created. Further, because two different types of connecting mechanisms may be used to interconnect the containers, the containers and/or lids may be selectively swapped, exchanged or switched in a number of different combinations and uses.

These and other aspects, features, and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE PREFERRED EMBODIMENTS

The present invention is directed towards a stackable container system. The principles of the present invention, however, are not limited to a stackable container system. It will be understood that, in light of the present disclosure, the stackable container system disclosed herein can be successfully used in connection with other types of containers, bottles, vessels, decanters, pitchers, receptacles and the like.

Additionally, to assist in the description of the stackable container system, words such as top, bottom, front, rear, right and left may be used to describe the accompanying figures. It will be appreciated, however, that the present invention can be located in a variety of desired positions, including various angles, sideways and even upside down. A detailed description of the stackable container system now follows.

Figure 1:
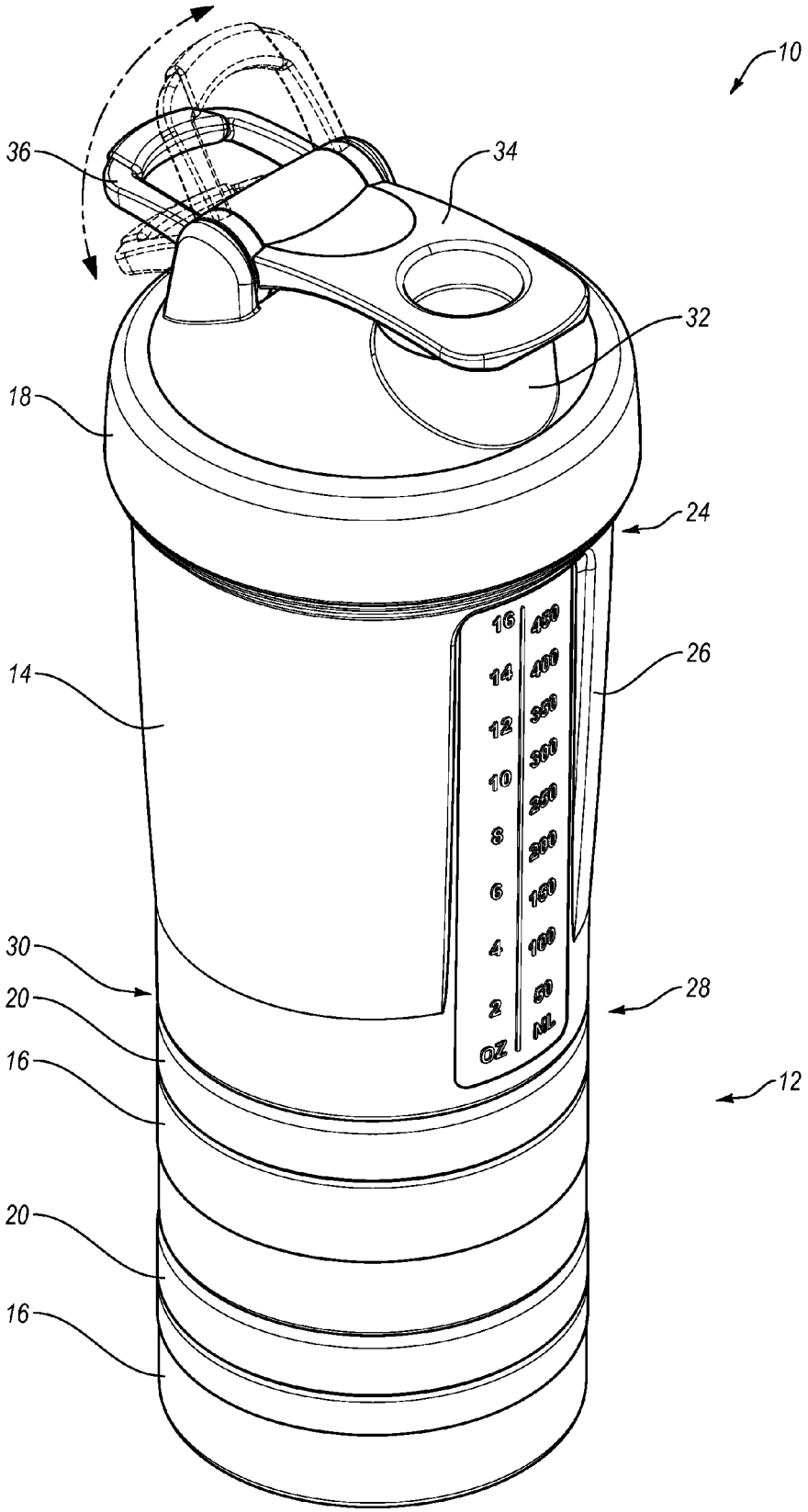
FIG. 1 is an upper perspective view an exemplary embodiment of a stackable container system, illustrating a primary container with a lid including a flip top and a handle or carrying member, a first selectively attachable and/or removable secondary container, and a second selectively attachable and/or removable secondary container.

As seen in FIG. 1, a stackable container system 10 may include one or more containers 12. The containers 12 may have different shapes, sizes, configurations, and arrangements depending, for example, upon the intended use of the stackable container system 10. The containers 12 may also be sized and configured to hold, retain and/or store one or more liquids and/or solids. In particular, the containers 12 can be used to store liquids and fluids such as beverages, water, juices and drinks. The containers 12 can also be used to store solids such as powders, ingredients, mixes, substances, foodstuffs and the like.

Figure 2:
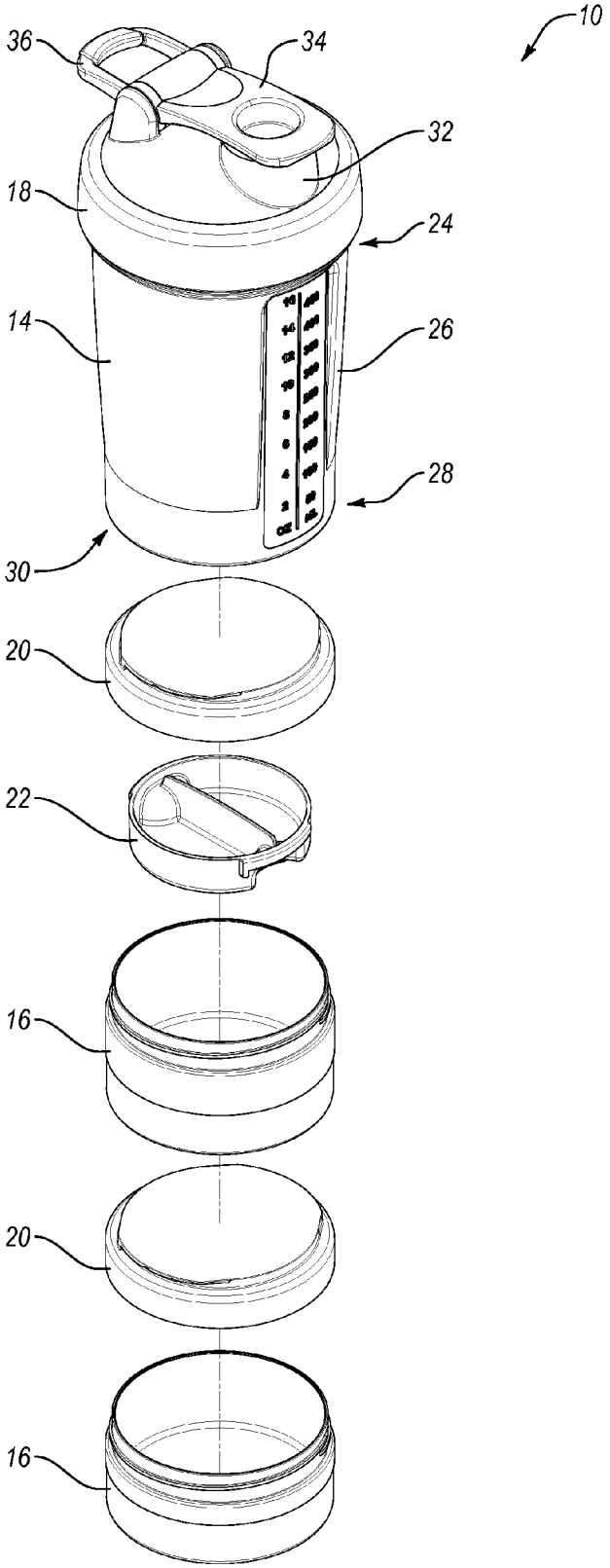
FIG. 2 is an upper perspective, exploded view of the stackable container system, illustrating the primary container, a first secondary container, a lid for the first secondary container, an optional tray that may be disposed within the first secondary container and attached to the lid of the first secondary container, a second secondary container, and a lid for the second secondary container.

As shown in FIGS. 1 and 2, the stackable container system 10 may include a plurality of containers 12, such as a primary container 14 and one or more secondary containers 16. The primary container 14 may include a lid 18 and the lid may be selectively attached to the container. The secondary containers 16 may also include lids 20 and the second container lids may allow one or more secondary containers to be connected and/or allow the secondary containers to be connected to the primary container 14. The primary containers 14, the secondary containers 16, the primary container lids 18 and the secondary container lids 20 may be interchangeable and that may allow the containers and lids to be connected or coupled as desired.

For example, the stackable container system 10 may include a primary container 14, which may also be referred to as a beverage container; a primary or beverage container lid 18; a plurality of secondary containers 16, which may be referred to as smaller containers; and a plurality of secondary or smaller container lids 20. The smaller containers 16 and the smaller container lids 20 may be configured to allow any of the smaller container lids to be used in connection with any of the smaller containers. The bottom or base of the beverage container 14 and the bottom or base of each of the smaller containers 16 may have the same or similar connecting or coupling mechanisms, which may allow the smaller container lids 20 to be connected to the beverage container or the smaller containers as desired.

In another example, the stackable container system 10 may include a beverage container 14, a beverage container lid 18, a plurality of smaller containers 16, a plurality of smaller container lids 20 and a divider or tray 22 that is sized and configured to be disposed in one of the smaller containers when a smaller container lid is attached to the smaller container. In particular, the smaller containers 16 and the smaller container lids 20 may be configured to selectively receive the tray 22, and the containers, lids and trays are may be at least partially interchangeable.

In greater detail, the stackable container system 10 may include a primary or beverage container 14 which may be configured to hold, store and/or transport liquids or fluids such as water, juices, drinks and the like. Additionally, the primary container 14 may contain different types and combinations of mixtures, infusions, solutions, blends, etc. While the primary or beverage container 14 may be generally intended to contain liquids, it can also hold solids or other items such as powders, pastes, gels, foodstuffs and the like. In addition, the primary container 14 may be sized and configured to allow items to be mixed or blended to create items such as shakes, smoothies, meal replacements, and the like. The primary container 14 may further be used to mix, blend or combine items such as pancake mix, eggs and other food items.

The primary container 14 may have a larger size than the secondary containers 16. For example, the primary container 14 may hold approximately 16, 18, 20, 22 or 24 ounces (or about 400, 500, 600, 700, 800, 900 ml or a liter). One of ordinary skill in the art will appreciate after reviewing this disclosure, that the primary container 14 could have any suitable size, include smaller and larger sizes. In addition, the primary container 14 may have a generally cylindrical or tube-shaped configuration with an upper portion 24, one or more side walls 26 and a lower portion 28. The upper portion 24 preferably includes a wide-mouth opening to the interior of the container 14 and a base 30 may be disposed at the lower portion 28 of the container. The container 14 is preferably tapered so that the upper portion 24 is larger than the lower portion 28. In particular, if the container 14 is generally cylindrical, then the diameter of the upper portion 24 may be larger than the diameter of the lower portion 28.

The primary container lid 18 may provide a cover or cap to the primary container 14 and the lid is preferably removably connected to the container. The lid 18 may include an opening 32, such as a spout, and the opening may facilitate pouring of the contents of the container. The opening 32 may also allow a person to drink from the container 14. A closure 34, such as a flip-top or flip-cap, may selectively close the opening 32. The closure 34 may be pivotally connected to the lid 18 and the closure may be sized and configured to remain in a closed and/or open position. The closure 34 may create an airtight and/or watertight seal with the opening 32, which may advantageously help create a leak-proof container.

The primary container lid 18 may include a handle or attachment member 36, which may facilitate carrying, holding and/or transporting the container 14 and/or the stable container system 10. The handle 36 may have a loop-shaped configuration and may be pivotally connected to the lid 18. Advantageously, the handle 36 may provide increased convenience and may be movable independently of the closure 34. One of ordinary skill in the art will appreciate after reviewing this disclosure that the container 14 and lid 18 may have other suitable shapes, sizes, configurations and arrangements such as shown in U.S. Pat. No. 8,695,830 which is incorporated by reference herein in its entirety. Further, while the lid 18 may include features such as the closure 34 and handle 36, these and other features may be optional and may be not required.

Figure 4:
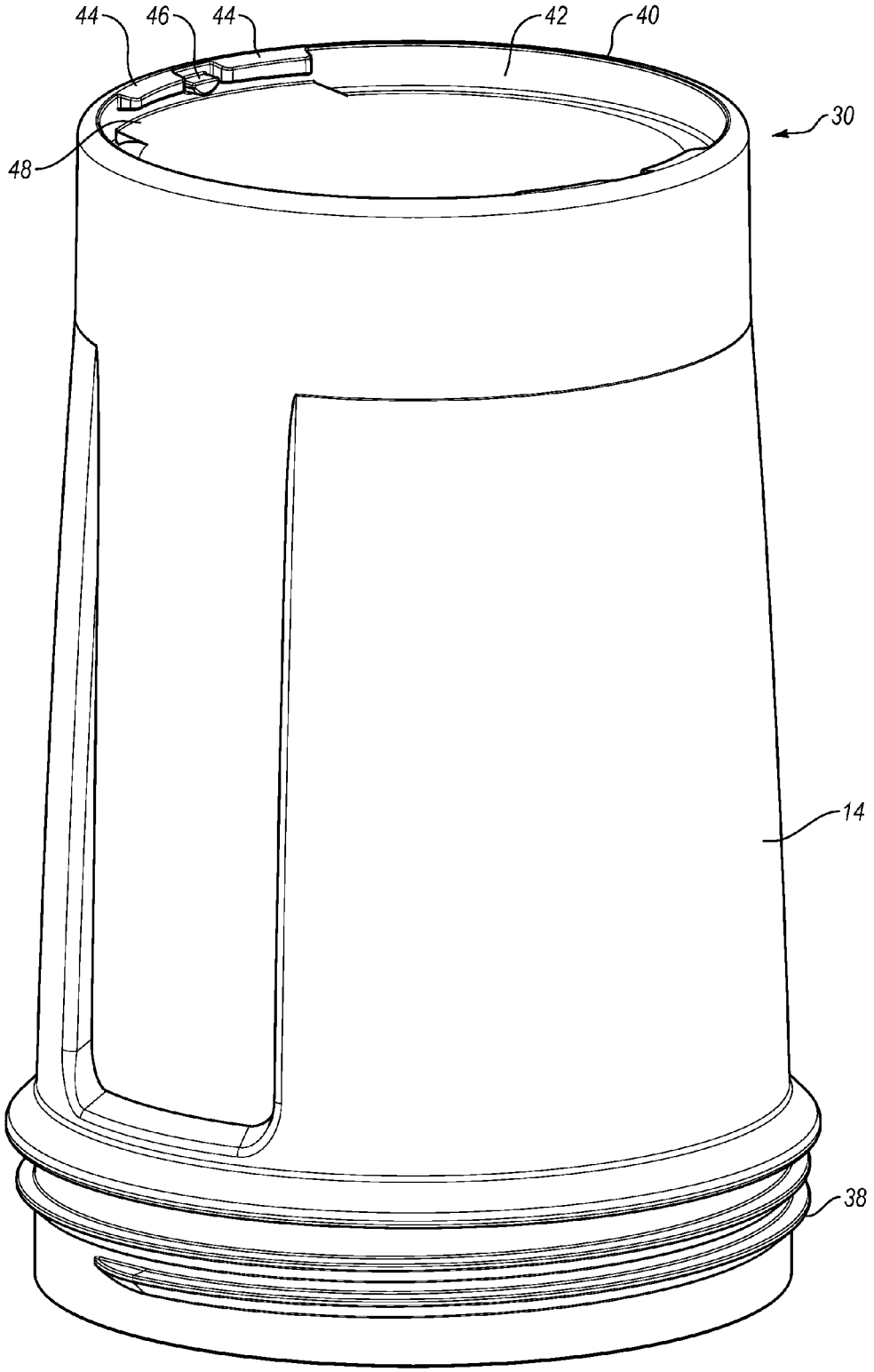
FIG. 4 is an enlarged, lower perspective view of a primary container.

The lid 18 may be connected to the upper portion 24 of the container 14 by a first type of connection such as a threaded or screw-type connection. For example, as shown in FIG. 4, the upper portion 24 of the container 14 may include one or more threads 38 and an inner portion of the lid 18 may include corresponding threads that allow the lid to be selectively attached to the container. This threaded connection of the lid 18 to the container 14 may create a secure, airtight, watertight and/or leak-proof seal. The threaded connection may require multiple turns of the lid 18 relative to the container 14 to securely connect the lid to the container, but it will be appreciated that the lid may be connected to the container by one or fewer turns. The lid 18 may also be connected to the container 14 using other suitable types of connections and structures depending, for example, upon the intended use of the container system.

The container 14 may have a tapered or conical shape with the upper portion 24 larger than the lower portion 28. Advantageously, the upper portion 24 may be sized and configured to allow one or more of the secondary containers 16 to be disposed inside the primary container 14. This may allow one or more of the containers 16 to be placed inside the upper portion 24 of the container 14 for storage and/or shipping, which may facilitate use of the container system 10. This may also allow a container system 10 to be transported and/or sold with one or more secondary containers 16 connected to the primary container 14 and one or more secondary containers disposed within the primary container. For example, a secondary container 16 may be connected a base of the primary container 14 and another secondary container may be disposed inside the primary container. This may allow the container system 10 to be shipped, displayed and/or packaged within a smaller area than a container system with two secondary containers 16 attached to the base 30 of a primary container 14, which may significantly reduce costs for the manufacture, retailer and/or consumer.

The base 30 of the container 14 may include a second type of connection, which is preferably different than the first type of connection at the upper portion 24 of the container. For example, the base 30 may include a twist and lock or bayonet-type connection. The second type of connection may allow a lid 20 to be connected to the base 30 by rotating the lid relative to the container 14. Preferably, the second type of connection allows the lid 20 to be connected to the base 30 with rotation of generally less than or equal to about half of a turn, a quarter of a turn, or less. The twist and lock type connection may include inserting a portion of the lid 18 into the base 30 and rotating the container 14 and/or the lid to connect the lid and container.

Figure 3:
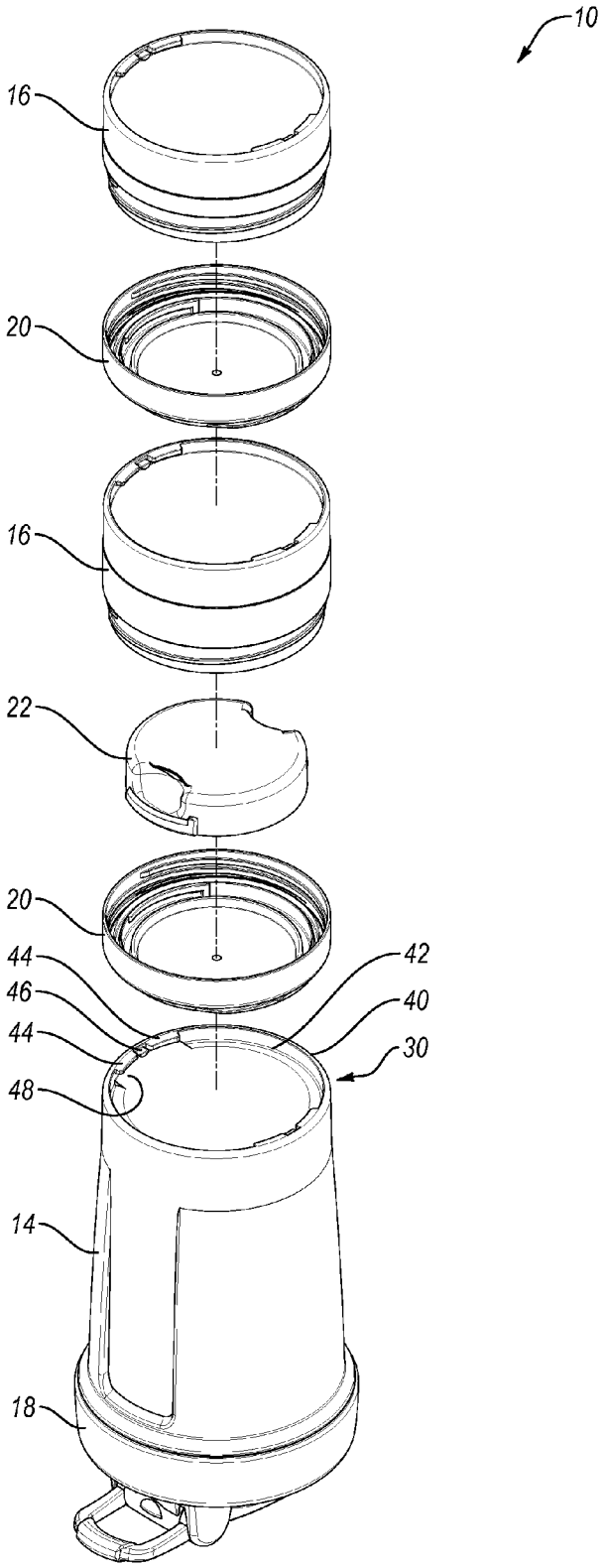
FIG. 3 is a lower perspective, exploded view of the stackable container system.

In greater detail, as seen in FIGS. 3 and 4, the base 30 may include an annular ring or a lip 40 that extends downwardly from the lower portion 38 of the container 14. The lip 40 may have a generally cylindrical or tubular-shape with an exterior surface that is at least substantially aligned with an outer surface of the side 26 of the container 14. The lip 40 may have an inner surface 42 with one or more inwardly extending flanges 44. In particular, the flanges 44 may protrude inwardly, be disposed generally parallel to a lower surface of the container 14, and an upper surface of the flanges may be sloped or angled relative to the lower surface of the container. As shown in the accompanying figures, a protrusion 46 may be disposed between a pair of flanges 44 and a gap or a space may be disposed between the protrusion and the flanges. The protrusion 46 may be sized and configured to be disposed in a corresponding receiving portion in a lid 20, which may help position and maintain the lid in a fixed position relative to the container 14. In addition, a guide 48, such as a ledge or shelf, may be disposed proximate the flanges 44. The protrusion 46 and the guide 48 may help position and/or connect the lid 20 to the container 14. The flanges 44, the protrusion 46 and/or the guide 48 may form at least a portion of a locking mechanism and the lock mechanism may help secure the lid 20 to the container 14. If desired, a first locking mechanism may be disposed on a first side of the base and a second locking mechanism may be disposed on an opposing second side of the base. One of ordinary skill in the art will appreciate after reviewing this disclosure that any suitable number of locking mechanisms may be used to connect the lid 20 to the base 30 of the container 14. It will also be appreciated that the locking mechanism may have other suitable shapes, sizes, configurations and arrangements depending, for example, upon the intended use of the container system 10.

As discussed above, the container system 10 may include one or more secondary or smaller containers 16. The secondary containers 16 may be sized and configured to store, hold or transport smaller volumes than the primary container 14, such as in the range of about 100 cc, 150 cc, 200 cc or 250 cc (or about 3 oz., 4 oz., 5 oz., 6 oz., 7 oz., or 8 oz.). It will be appreciated that the secondary containers 16 may also, individually or collectively, have a larger volume than the primary container 14.

The secondary containers 16 may be sized and configured to hold, store and/or transport liquids, powders (such as protein powders, powdered supplements, etc.), vitamins, foodstuffs, perishables, mix-ins and the like. These items may be mixed, blended or combined with the liquids or other items in the other containers, if desired. The secondary containers 16 may have a cylindrical or tube-shaped configuration. Desirably, the secondary containers 16 may have a diameter at least proximate a diameter of the lower portion 28 of the primary container 14. Advantageously, if the secondary containers 16 and the lower portion 28 of the primary container 14 have generally the same size and configuration, that may facilitate attachment of the primary and secondary containers.

Two exemplary secondary containers 16 are shown in FIGS. 7A, 7B, 8A and 8B and the main differences between these containers may be the size of the containers. For example, the container 16 shown in FIGS. 7A and 7B may be sized and configured to contain about 150 cc (5 oz.) and the container shown in FIGS. 8A and 8B may be sized and configured to contain about 100 cc (3.4 oz.). The containers 16 shown in FIGS. 7A, 7B, 8A and 8B may have similar features and structures, which may facilitate the use and interchangeability of the containers. The containers 16, however, could have different shapes, sizes, configurations and arrangements depending, for example, upon the intended use of the container system 10.

In greater detail, the secondary containers 16 may include an upper portion 50, a sidewall 52 and a lower portion 54. If the secondary container 16 has a cylindrical configuration, then the upper portion 50 and the lower portion 54 may have a diameter that is at least substantially the same. The upper portion 50 may include a first connecting mechanism 56, such as a threaded or screw-type connection, which is sized and configured to be attached or coupled to a secondary container lid 20. In particular, the upper portion 50 may include one or more threads 58 that may allow the container 16 to be securely connected to the secondary container lid 20.

Figure 8A:
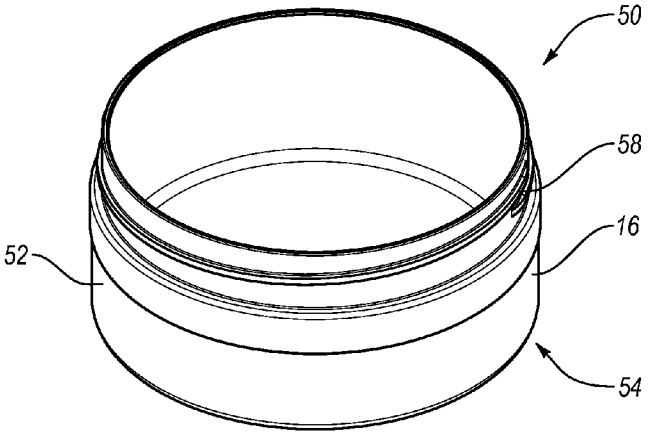
FIG. 8A is an upper perspective view of an exemplary secondary container of a second size.
Figure 8B:
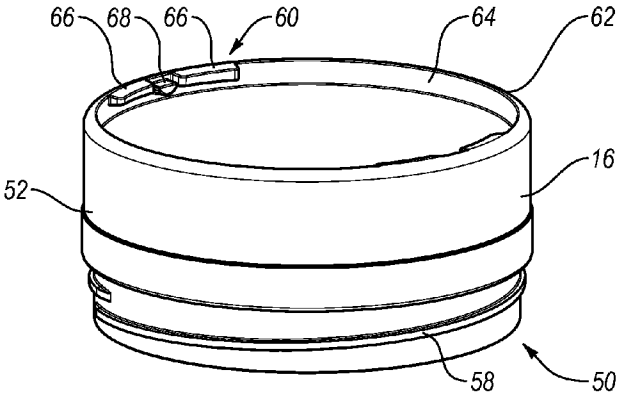
FIG. 8B is a lower perspective view of the secondary container shown in FIG. 8A.
Figure 7A:
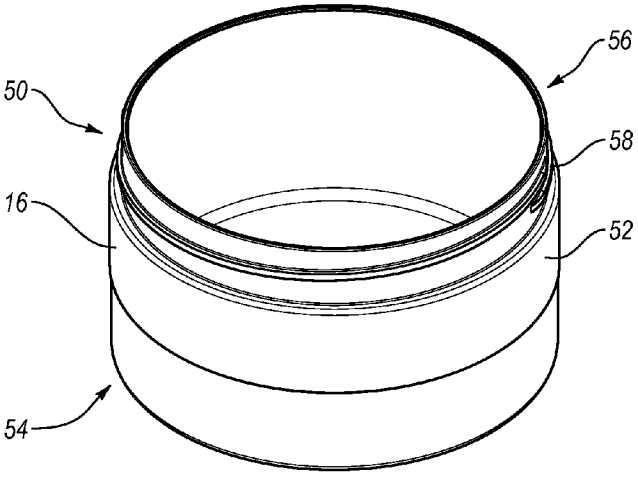
FIG. 7A is an upper perspective view of an exemplary secondary container of a first size.
Figure 7B:
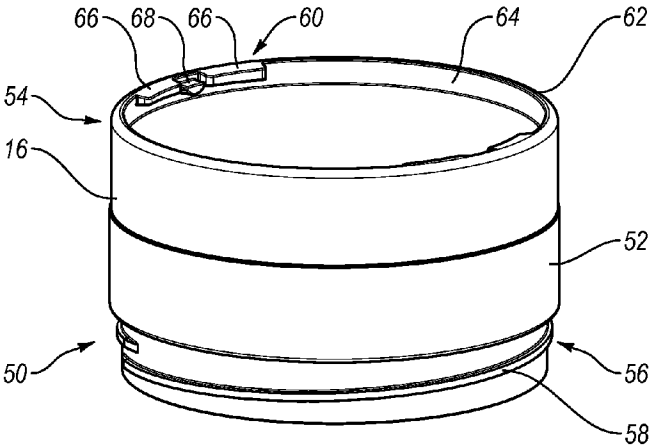
FIG. 7B is a lower perspective view of the secondary container shown in FIG. 7A.

The lower portion 54 of the secondary container 16 may include a second connecting mechanism 60, such as a twist and lock or bayonet-type structure, which may allow the base or bottom portion of the secondary container to be attached to a secondary container lid 20. The second connecting mechanism 60 may be generally the same or identical to the second connecting mechanism disposed on the base 30 of the primary container 14. Advantageously, this may allow the secondary container lids 20 to be interchangeably attached to the primary and/or secondary containers 14, 16. In greater detail, as seen in FIGS. 7B and 8B, the lower portion 54 of the secondary container 16 may include an annular ring or a lip 62 that extends downwardly from the lower portion 54 of the container 16. The lip 62 may have a cylindrical or tubular-shape with an exterior surface that is aligned with an outer surface of the sidewall 52 of the container 16. The lip 62 may have an inner surface 64 with one or more inwardly extending flanges 66. In particular, the flanges 66 may protrude inwardly and an upper surface of the flanges may be sloped or angled. As shown in the accompanying figures, a protrusion 68 may be disposed between a pair of flanges 66. If desired, the protrusion 68 may be sized and configured to move, deform or deflect when the lid 20 is connected to the container 16. In addition, a gap or space may be disposed between the protrusion 68 and the flanges 66, and the protrusion may be sized and configured to be disposed in a corresponding receiving portion in the lid 20, which may help lock the lid into a fixed position relative to the container 16. A guide 70, such as a ledge or shelf, may be disposed proximate the flanges 66 and protrusion 68 to help connect the lid 20 to the container 16. The flanges 66, the protrusion 68 and/or the guide 70 may form at least a portion of a first locking mechanism. As shown in the accompanying figures, a first locking mechanism may be disposed on a first side of the lower portion 54 of the container 16 and a second locking mechanism may be disposed on an opposing second side of the lower portion of the container. One of ordinary skill in the art will appreciate after reviewing this disclosure that any suitable number of locking mechanisms may be used to connect the lid 20 to the container 16. It will also be appreciated that the locking mechanism may have other suitable shapes, sizes, configurations, and arrangements depending, for example, upon the intended use of the container system 10.

Figure 5A:
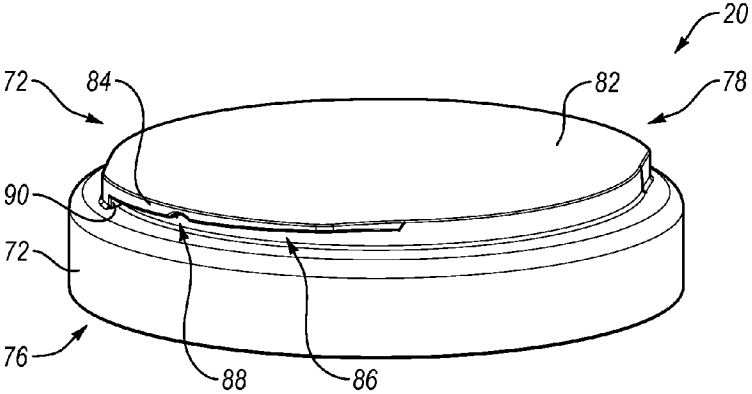
FIG. 5A is an upper perspective view of an exemplary secondary container lid.
Figure 5B:
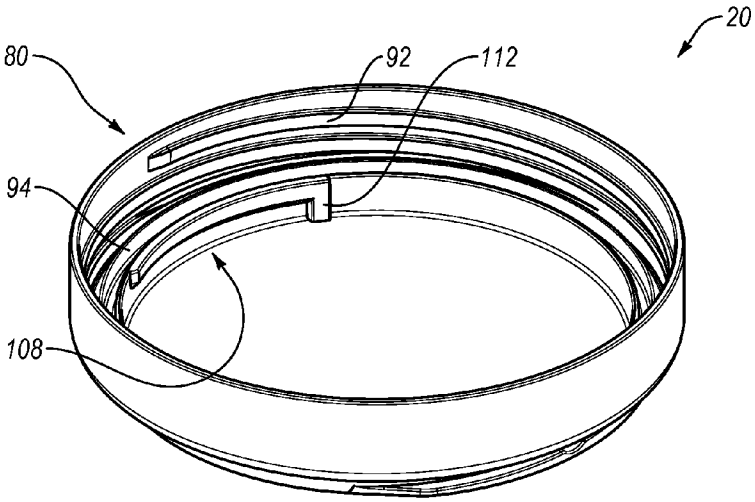
FIG. 5B is a lower perspective view of the secondary container lid shown in FIG. 5A.

The smaller container lids 20, which may be best seen in FIGS. 5A and 5B, may include an upper portion 72, a sidewall 74 and a lower portion 76. An upper attachment portion 78 is preferably disposed about the upper portion 72 of the lid 20 and a lower attachment portion 80 is preferably disposed about the lower portion 76 of the lid. The upper and lower attachment portions 78, 80 may be different structures. For example, the upper attachment portion 78 may be a twist and lock, or bayonet-type structure that allows the upper portion 72 of the lid 20 to be connected to the base 30 of the primary container 14 and/or the lower portion 54 of the secondary container 16. The lower attachment portion 80 may be a threaded or screw-type structure that allows the lower portion 76 of the lid to be attached to the upper portion of the secondary containers 16.

In greater detail, the upper attachment portion 78 may include an upwardly extending portion 82 that is sized and configured to allow the lid 20 to be attached to the base 30 of the primary container 14 or the lower portion 54 of the secondary container 16. The upwardly extending portion 82 may have a generally circular configuration with one or more engaging portions 84. For example, as shown in the accompanying figures, the lid 20 may include a pair of engaging portions 84 disposed on opposing sides of the upwardly extending portion 82 and the engaging portions may extend outwardly from the upwardly extending portion. The upwardly extending portion 82 and the engaging portions 84 may form at least a portion of a receiving portion 86 and the receiving portion may be sized and configured to receive the flanges 44, 66 of the containers 14, 16, respectively. In addition, the engaging portions 84 may include a notch or detent 88 that is sized and configured to receive the protrusion 46, 68 of the containers 14, 16. Advantageously, when the protrusion 44, 68 is disposed in the detent 88, that may help lock the lid 20 in position. The upper attachment portion 78 may further include an end wall 90 that is sized and configured to contact a flange 44, 66, which may help position the lid 20 in the desired location and/or prevent over rotation of the lid relative to the container 14, 16.

The lower attachment portion 80 may include a threaded connection which allows the lid 20 to be connected to any of the secondary containers 16. In particular, the lid 20 may include one or more threads 92 that allow the lid to be connected to the container 16 by a threaded or screw-type connection. The lid 20 may also include a receiving portion 94, such as a groove or channel, which is sized and configured to receive an upper portion of the container 16 and that may help create a secure connection and/or seal between the container and the lid. Desirably, the container 16 and the lid 20 have an airtight and/or watertight seal. In addition, the lids 20 may have at least the same general size and configuration, which may allow the lids to be interchangeably connected to any desired container 14, 16. The lids 20 may also be switched and swapped as desired, which may facilitate use of the stackable container system 10.

Figure 6A:
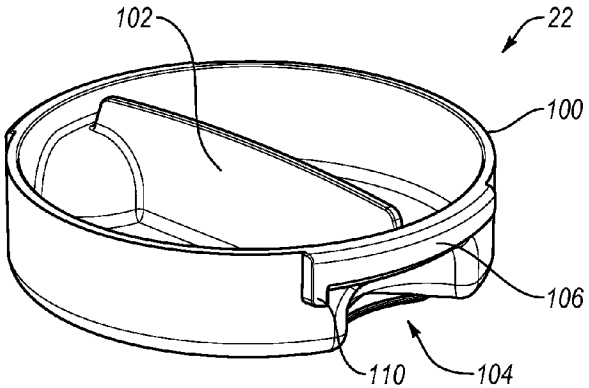
FIG. 6A is an upper perspective view of an exemplary tray that may be disposed inside of a secondary container and the tray may be attached to a lid of a secondary container.
Figure 6B:
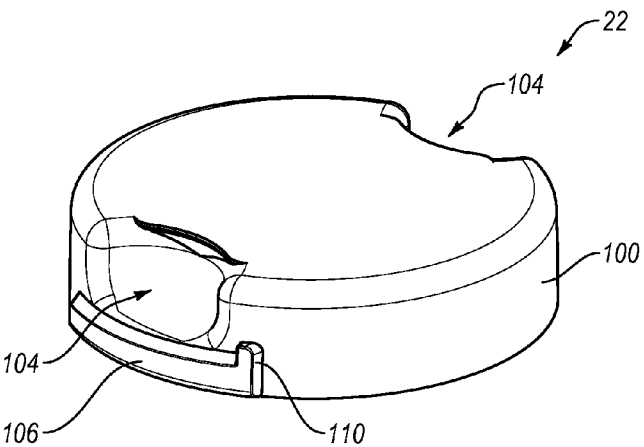
FIG. 6B is a lower perspective view of the tray shown in FIG. 6A.

As discussed above, the tray or divider 22 may be optionally and selectively attached to the lid 20. Preferably, the tray 22 is attached to the lid 20 in a manner that does not interfere with the lid being attached to the container 14, 16. The tray 22, as shown in FIGS. 6A and 6B, may include a body 100 with one or more dividers, such as a cneeetral divider 102. The tray 22 may also include one or more cutouts, depressions, fingerholds, grips or handles 104 to facilitate selective attachment and removal of the tray 22 to the lid 20. In addition, the tray 22 may include one or more outwardly extending flanges 106 that are sized and configured to be disposed in corresponding receiving portions 108 in an upper, inner surface of the lid 20. The flanges 106 may include an angled surface and that may facilitate insertion of the flange into the receiving portion 108. Additionally, an end wall 110 may be disposed at least proximate an end of the flange 106 and an end wall 112 may be disposed at least proximate an end of the receiving portion 108. The end walls 110, 112 may limit the rotation of the tray 22 relative to the lid 20 and may help create a secure seal between the tray and the lid. Advantageously, the tray 22 may provide a convenient place to store items such as pills, powders, supplements, vitamins, medicines and the like. While each of the lids 20 may be sized and configured to receive the tray 22, it would be appreciated that only some of the lids may be sized and configured to be attached to a tray. It will also be appreciated that the tray 22 is an optional feature that may not be required.

As set forth above, the stackable container system 10 may comprise a primary container 14, a primary container lid 18, a plurality of smaller containers 16 and a plurality of smaller container lids 20. The base 30 of the primary container 14 may be configured to allow the container to be connected to any of the one smaller container lids 20. The smaller container lids 20 may also be selectively connected to any of the smaller containers 16. For example, as shown in the accompanying drawings, the stackable container system 10 may include one beverage container 14, one beverage container lid 18, two smaller containers 16, two smaller container lids 20 and one tray 22. One of ordinary skill in the art will appreciate after reviewing this disclosure that the stackable container system 10 may include any suitable number of containers 12, 14, 16; lids 18, 20; and trays 22. Further, one of ordinary skill in the art will appreciate that the stackable container system 10 is not limited to any particular type of containers 12, 14, 16; lids 18, 20; and trays 22. For example, of containers 12, 14, 16; lids 18, 20; and trays 22 may have other suitable shapes, sizes, configurations and arrangements depending, for example, upon the intended use of the stackable container system 10. One of ordinary skill in the art will also appreciate that the lids 18, 20 can be attached to the containers 14, 16 via threads either on the inside or outside of containers, or other means as known in the art. While the top of each of the lids 20 is configured to allow lid to be attached to the bottom of a container 14, 16, the lid could be attached to any suitable portion of the container. Further, while the containers 12, 14, 16 and the lids 18, 20 may be sized and configured to allow the containers and lids to be interconnected to form a stack, the containers and the lids do not have to be stackable.

Advantageously, because each container 12 (such as the beverage container 14 and the smaller containers 16) may include a separate lid (such as the beverage container lid 18 and the smaller container lid 20), each container may be independently sealable. In other words, the stackable container system 10 may comprises a plurality of containers 12 that can each be sealed and used independently of the other containers, while still being interconnectable to form a single stackable container system.

As discussed above, the lids 20 may be connected or coupled to the bottom of the containers 14, 16 using a twist and lock structure, which may also be referred to as a bayonet type mount. Although a bayonet type mount may be used, any type of connection can be used to secure the lids 20 to the containers 14, 16 including by threading, snapping, twisting, sliding, or screwing the lids onto the bottom of the containers.

Significantly, the stackable container system 10 can be used to store liquids and/or ingredients separately until the user desires to consume and/or mix the liquids and ingredients. For example, a user can put ingredients for a protein shake in one or more of the smaller containers 16 and a liquid, such as water or mild, in the larger container 14. Once the user desires to mix the protein shake, he or she can remove the smaller container(s) 16 to add the contents to beverage container 14, add liquid if necessary to beverage container, and mix the contents within beverage container.

The stackable container system 10 can also be used to store ingredients for later use. In addition, the stackable container system 10 can be used to mix one or more ingredients for any type of beverage or pourable substance such as, for example, baby formula, ingredients for salad dressing, ingredients for pancake batter, nutritional drink mixes, ingredients for inedible substances (e.g., paints), etc. Accordingly, the stackable container system 10 should not be limited to any particular use (including to uses for mixing edible substances), and the stackable container system can be used for storing and/or mixing ingredients whether the ingredients are for beverages or other edible mixes, or for an inedible mixes.

Figure 9:
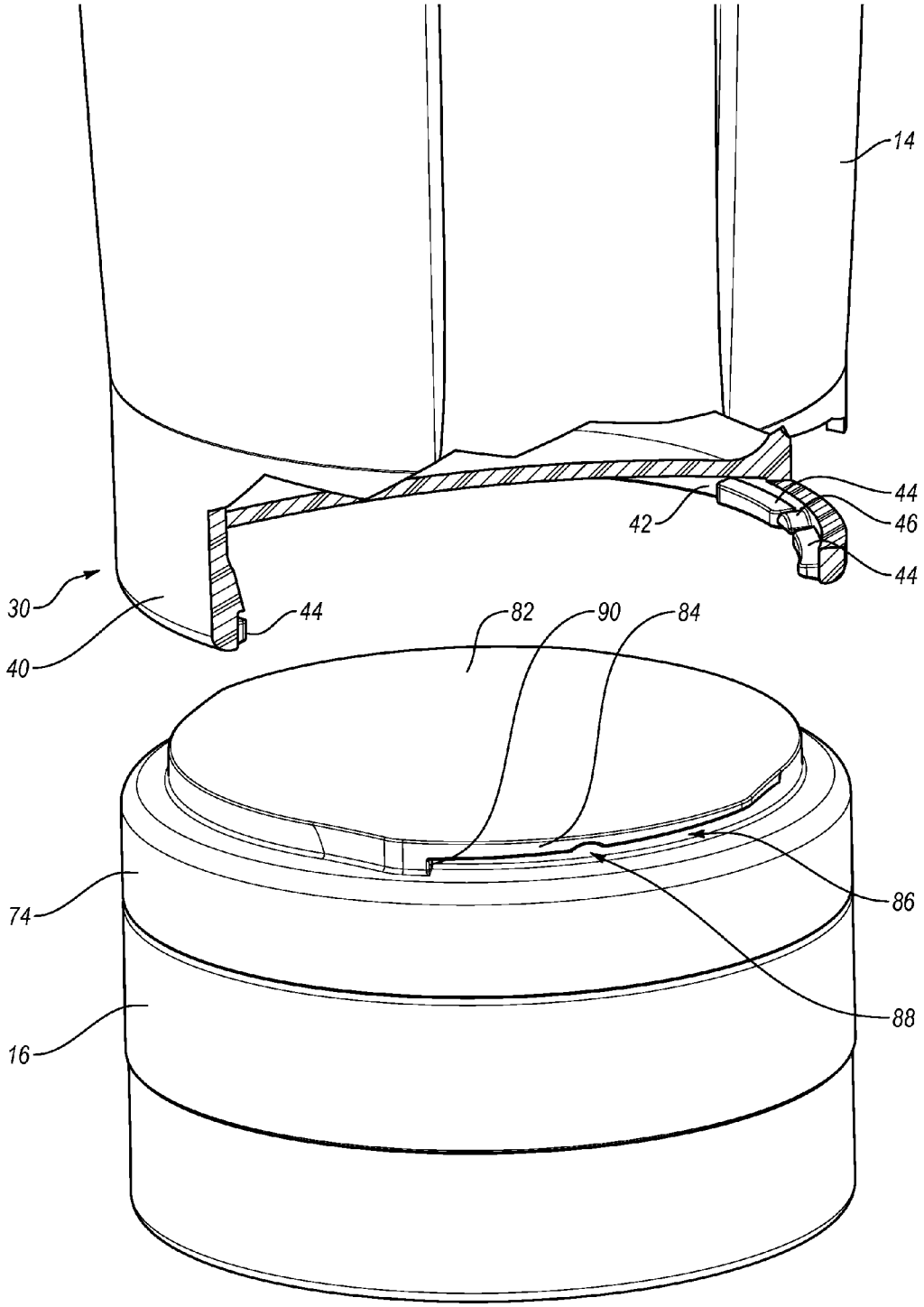
FIG. 9 is an upper perspective, exploded, partial cutaway view of an exemplary primary container and a secondary container.
Figure 10:
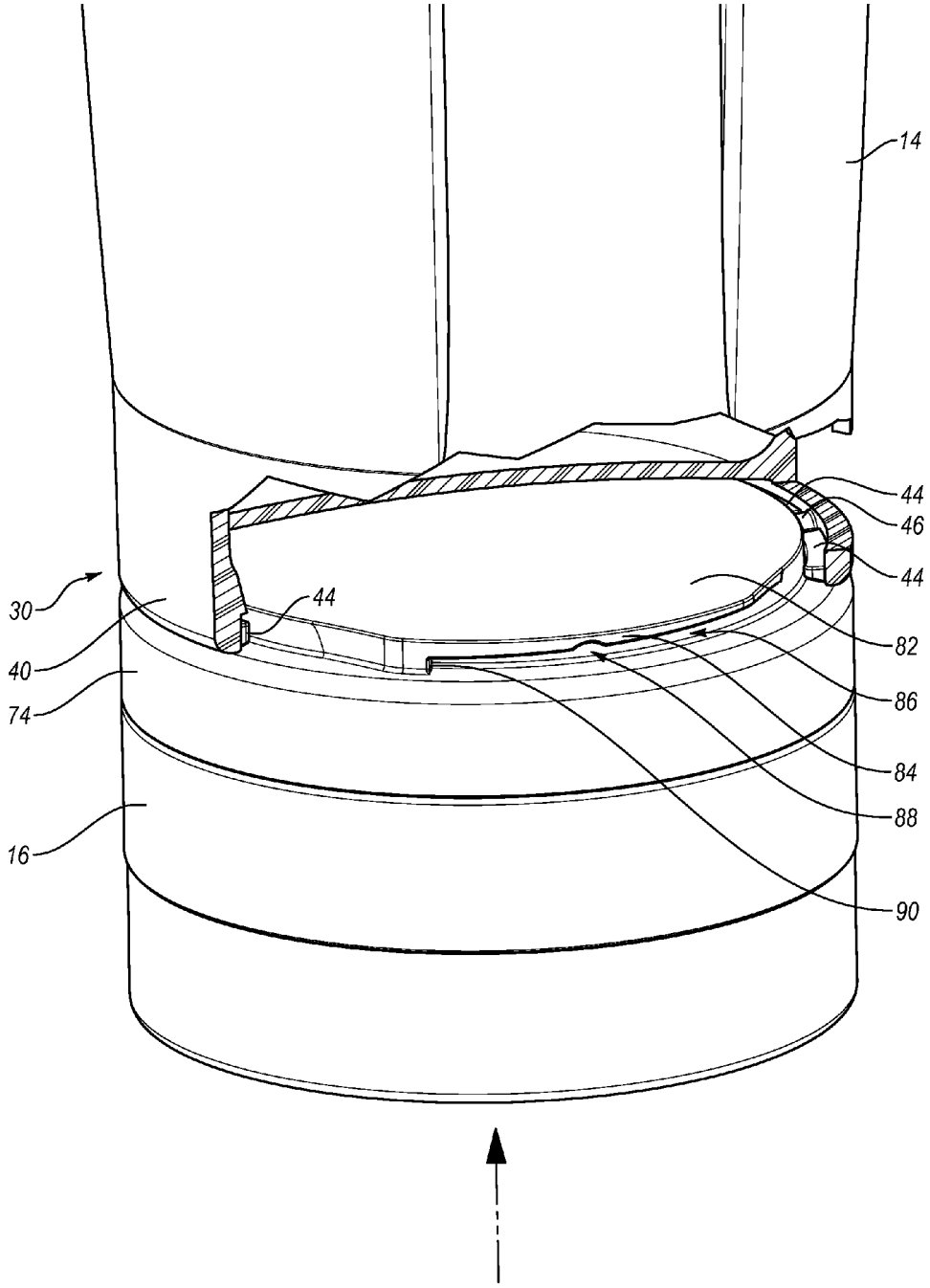
FIG. 10 is an upper perspective, partial cutaway view of the containers shown in FIG. 9, illustrating the containers in a first, unlocked position.
Figure 11:
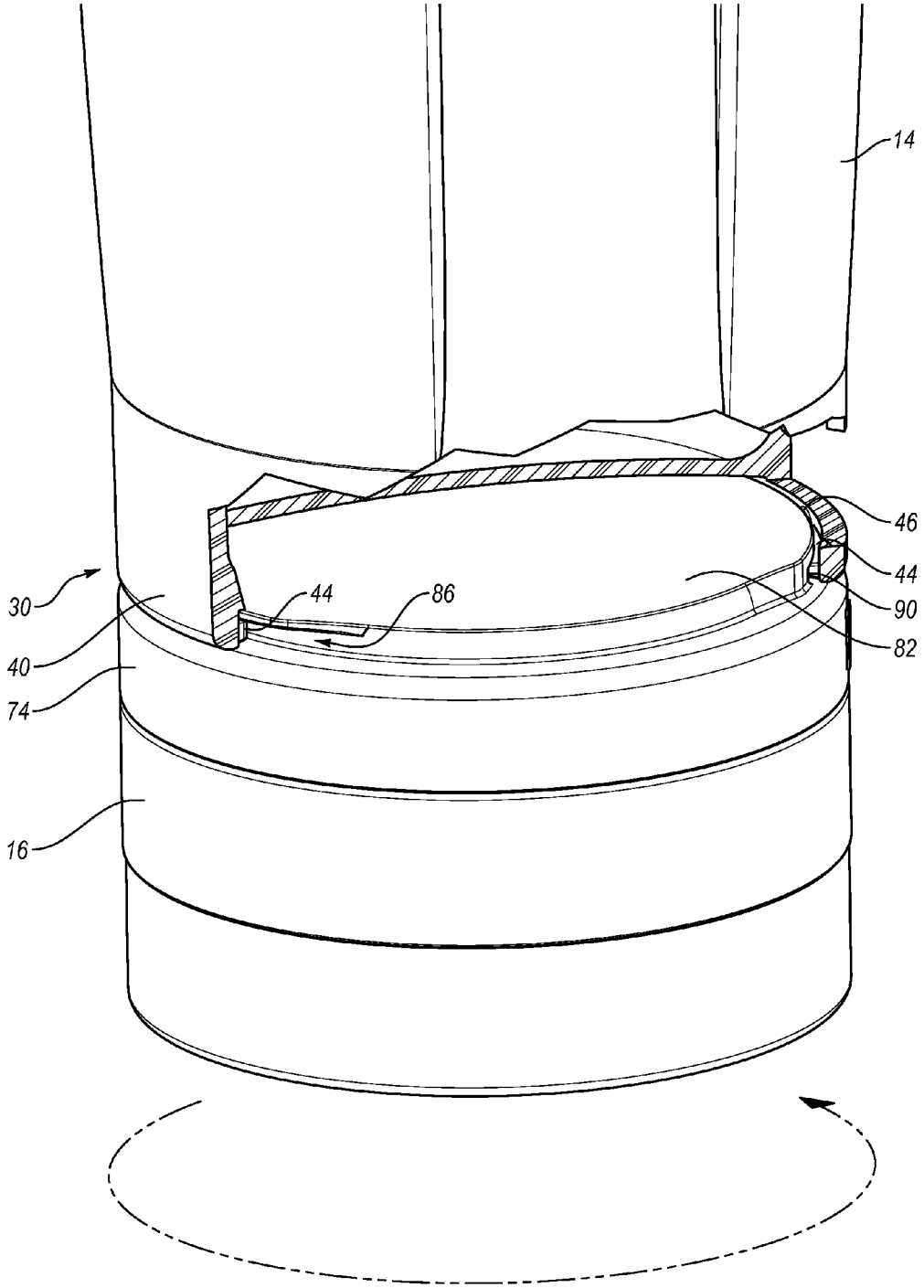
FIG. 11 is an upper perspective, partial cutaway view of the containers shown in FIG. 9, illustrating the containers in a second, locked position.

Exemplary embodiments illustrating the use of the stackable container system 10 is shown in FIGS. 9-14. For example, as shown in FIG. 9, the lid 20 may be attached to a secondary container 14 and the upper portion 72 of the lid may be disposed proximate the base 30 of the primary container 14. As illustrated in FIG. 10, the upper portion 72 of the lid 20 may be inserted into the base 30 of the primary container 14. As shown in FIG. 11, the lid 20 and the container 14 may be rotated such that the flanges 44 and the protrusion 46 are disposed in the receiving portion 86. Advantageously, when the protrusion 46 is disposed in the detent 88, that may indicate the lid 20 is in the locked position and/or help maintain the lid in the locked position. When it is desired to detach the lid 20 from the container 14, the lid can simply be rotated in the opposition direction to remove the flanges 44 and the protrusion 46 from the receiving portion 86.

Figure 12:
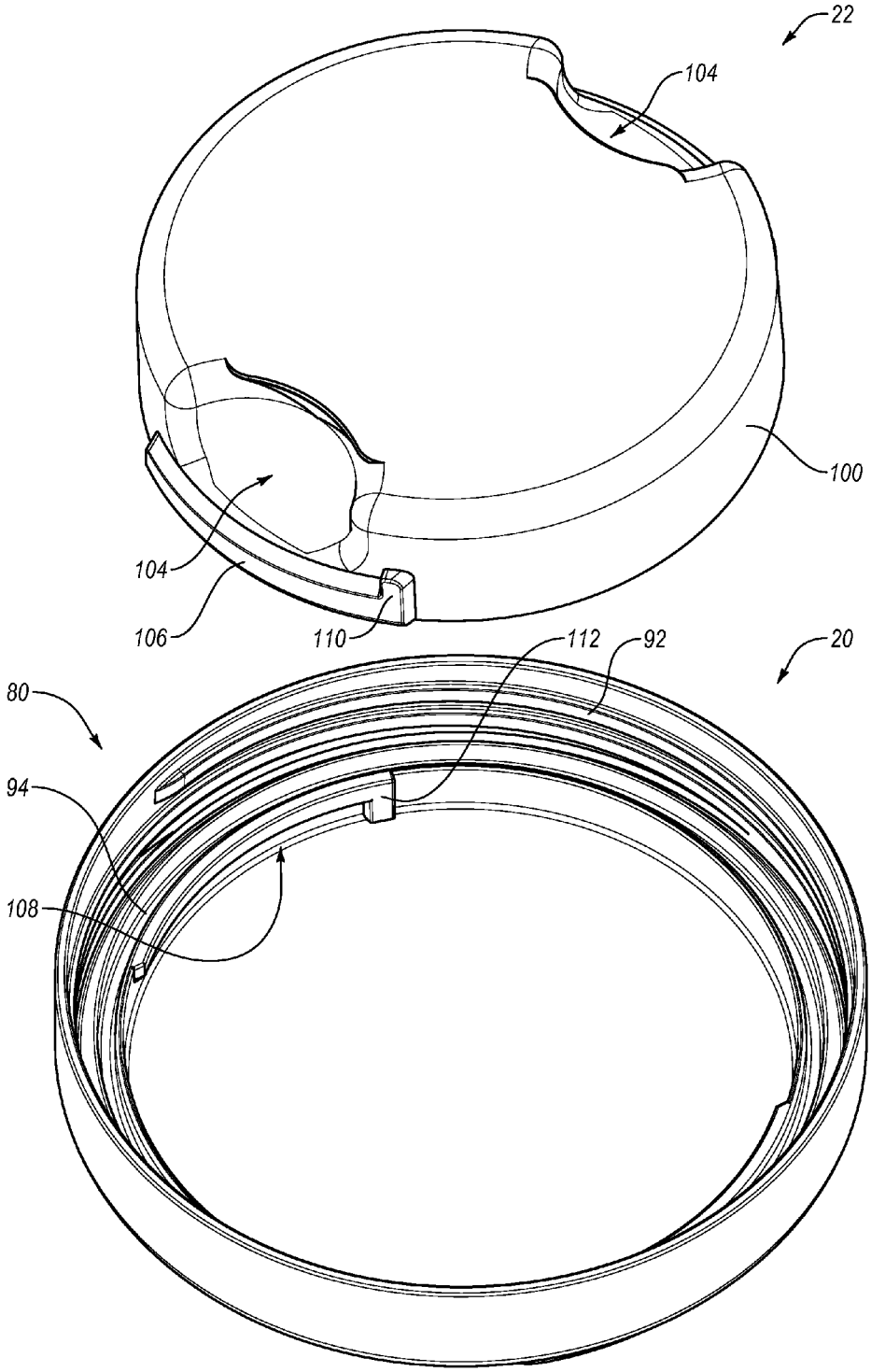
FIG. 12 is a lower perspective view of an exemplary tray and a lid for a secondary container.
Figure 13:
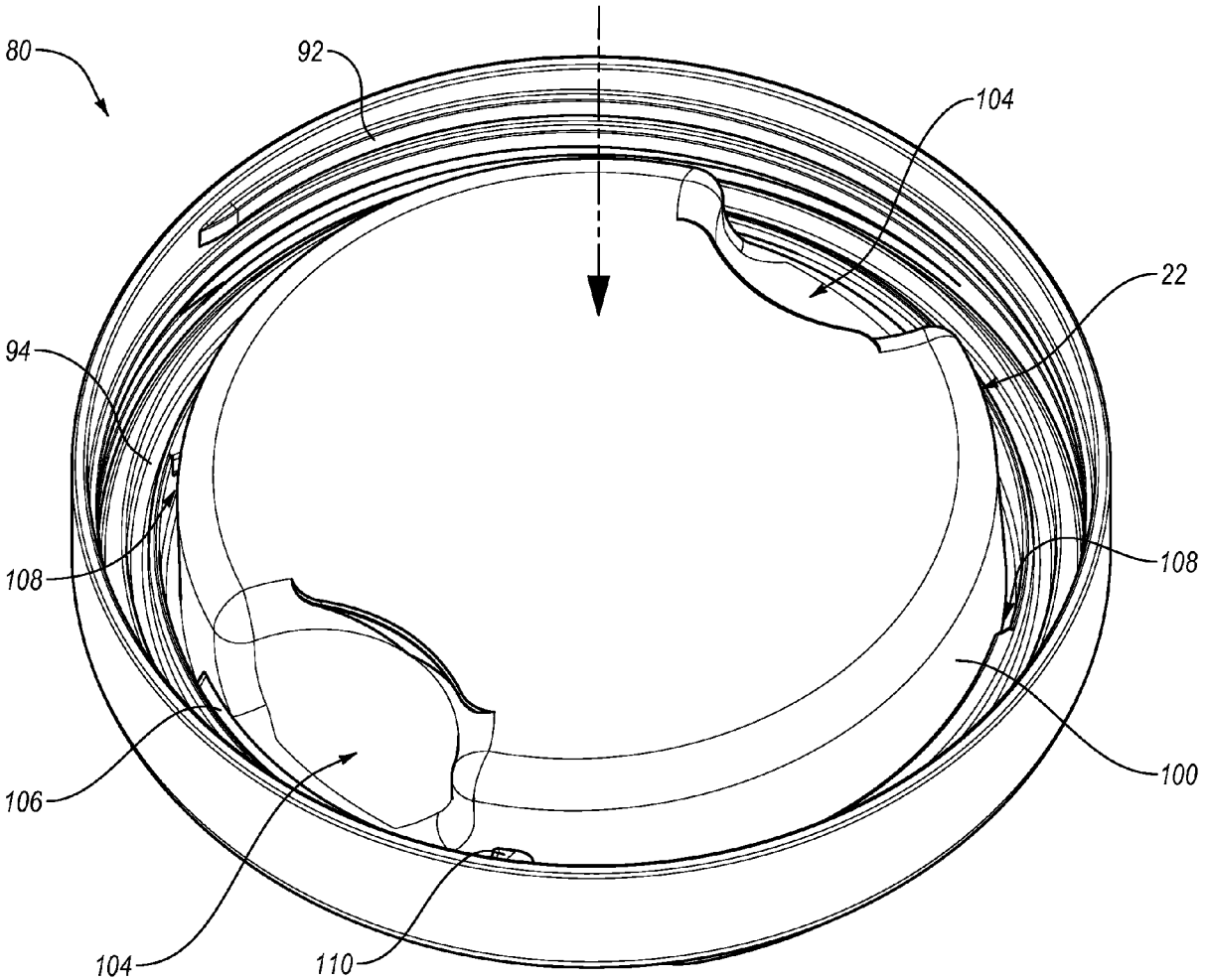
FIG. 13 is a lower perspective view of the tray and secondary lid shown in FIG. 12, illustrating the tray disposed in the lid and in a first, unlocked position.
Figure 14:
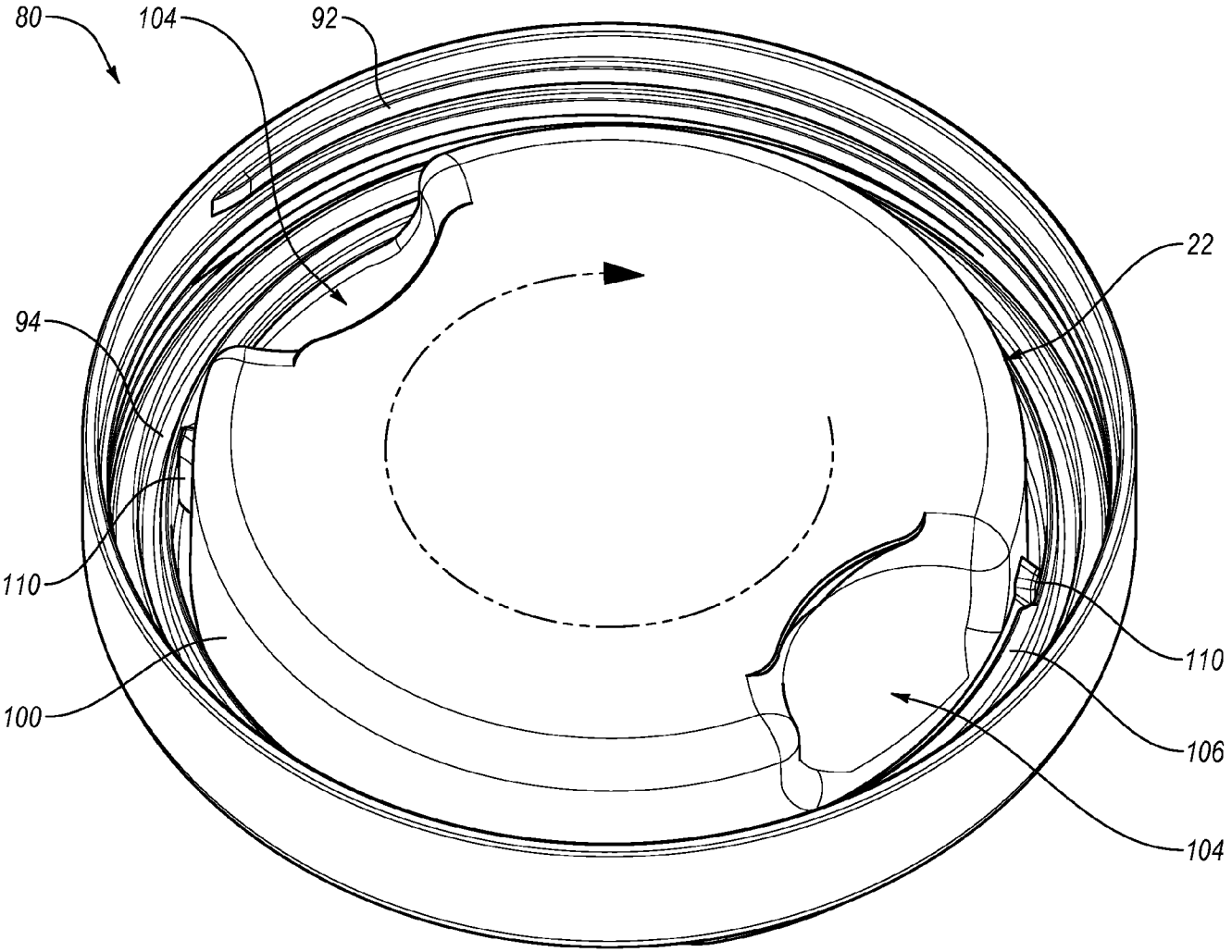
FIG. 14 is a lower perspective view of the tray and secondary lid shown in FIG. 12, illustrating the tray in a second, locked position.

The tray 22 may be selectively connected to the lid 20 by placing the tray proximate the inner portion of the lid, as shown in FIG. 12. In greater detail, the lid 20 and the tray 22 may be positioned to allow the tray to be connected or coupled to an upper, inner portion of the lid. The tray 22 may be inserted into the lid 20 such that an upper portion of the tray contacts or is disposed at least proximate an upper, inner surface of the lid. As shown in FIG. 12, the flange 106 is preferably not aligned with the receiving portion 108 when the tray 22 is inserted into the lid 20. After the tray 22 is inserted into the lid 20, as shown in FIG. 13, the one or more flanges 106 may be aligned with one or more of the receiving portions 108. As shown in FIG. 14, the lid 20 and/or tray 22 can be rotated so that the one or more flanges 106 are inserted into the one or more receiving portions 108. This connection of the tray 22 to the lid 20 may create a watertight and/or airtight seal between the tray and the lid. The protrusion or wall 110 of the tray 22 and/or the protrusion or wall 112 of the lid 20 may be sized and configured to lock the tray in a desired position and/or control the positioning of the tray within the lid. The walls 110, 112 may also help control the rotation of the tray 22 relative to the lid 20.

Advantageously, the indents or grips 104 may be generally aligned and disposed proximate the flanges 106, which made assist in connecting the lid 20 and tray 22. For example, the positioning of the grips 104 may provide an indication or guide when placing the tray 22 within the lid 20. The grips 104 may also facilitate selectively attaching the tray 22 to the lid 20. For instance, the grips 104 may be used to help rotate the tray into a locked or unlocked position. One of ordinary skill in the art will appreciate after reviewing this disclosure that the lid 20 and the tray 22 may be connected or coupled using other suitable structures and that features such as the grips 104 and walls 110, 112 may not be required.

The stackable container system 10 shown in the figures includes three exemplary containers 12 and it will be evident to one of ordinary skill in the art after reviewing the disclosure of the application that the container system may include any suitable number of containers 12, lids 20 and trays 22. For example, the container system 10 may comprise a single container 12 and the container system may comprise a plurality of containers. It will also be understood after reviewing the disclosure of the application that the containers 12 may have different shapes, sizes, configurations and arrangements depending, for example, upon the intended use of the containers. It will further be understood that one or more of the containers 12 may be interchangeable and/or selectively connected. Finally, it will further be understood that the containers 12 may be connected in any desired order, configuration and arrangement, and the containers may include various items such as bottles, vessels, decanters, pitchers, receptacles and the like.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A stackable beverage container system comprising:

a beverage container;

a beverage container lid, the beverage container lid selectively attached to an upper portion of the beverage container by a first coupling mechanism, the beverage container lid comprising:

an opening in an upper surface of the beverage container lid;

a closure pivotally connected to the beverage container lid, the closure selectively covering the opening and movable between an open position and a closed position; and an attachment member pivotally connected to the beverage container lid;

a plurality of smaller containers; and a plurality of smaller container lids;

wherein the plurality of smaller containers and the plurality of smaller container lids are configured to allow any of the smaller container lids to be connected to any of the smaller containers, the smaller containers and the smaller container lids selectively attached by the same type of coupling mechanism as the first coupling mechanism that selectively attaches the beverage container lid to the upper portion of the beverage container; and wherein a base of the beverage container and a base of each smaller container is configured to connected to an upper portion of any of the smaller container lids, the base of the beverage container and the base of the smaller containers selectively attached by a second coupling mechanism that is a different type than the first coupling mechanism.

2. The stackable beverage container system as in claim 1, wherein the base of the beverage container and the upper portion of the smaller container lids are configured to be connected with a bayonet mount for interlocking and connecting the smaller container lids with the beverage container; and wherein the base of the smaller containers and the upper portion of the smaller container lids are configured to be connected with a bayonet mount for interlocking and connecting the smaller container lids with the smaller containers.

3. The stackable beverage container system as in claim 1, wherein the upper portion of the smaller container lids includes a flange that is configured to be disposed in a receiving portion disposed in the base of the beverage container and in the base of the smaller containers.

4. The stackable beverage container system as in claim 1, wherein the smaller containers are sealable with the smaller container lids independently from the beverage container.

5. The stackable beverage container system as in claim 1, wherein an upper portion of the beverage container has a first outer diameter, the base of the beverage container has a second outer diameter that is smaller than the first outer diameter;

wherein an upper portion of each of the smaller containers has a diameter that is equal to or substantially equal to a diameter of a lower portion of each of the smaller containers; and wherein the diameter of the upper portion and lower portion of each of the smaller containers is equal to or substantially equal to the second diameter of the beverage container.

6. The stackable beverage container system as in claim 1, wherein a threaded connection is used to couple the beverage container lid to the beverage container;

wherein a threaded connection is used to couple the smaller container lids to the smaller containers; and wherein a bayonet-type connection is used to connect the smaller container lids to the base of the beverage container and the base of the smaller containers.

7. The stackable beverage container system as in claim 1, further comprising a tray that is selectively attachable to the smaller container lids, the smaller container lids being connectable to the smaller container if the tray is attached to the smaller container lids, the tray substantially disposed within the smaller container lid when attached to the smaller container lid.

8. The stackable beverage container system as in claim 1, wherein the first coupling mechanism is a threaded connection and the second coupling mechanism is a bayonet-type connection; and wherein the beverage container lid is not connectable to the smaller containers because the beverage container lid has a larger inner diameter than an inner diameter of the smaller containers.

9. The stackable beverage container system as in claim 1, further comprising a tray and a tray coupling mechanism disposed in an upper, inner portion of the smaller container lids, the tray selectively coupled to the tray coupling mechanism.

10. The stackable beverage container system as in claim 9, wherein the tray is selectively coupled to any tray coupling mechanism in any smaller container lid; and wherein the smaller container lid can be selectively coupled to any smaller container lid.

11. A stackable container system comprising:

a primary container;

a primary container lid, the primary container lid selectively attached to an upper portion of the primary container by a first coupling mechanism, the primary container lid comprising:

an opening in an upper surface of the primary container lid; and a closure pivotally connected to the primary container lid, the closure selectively covering the opening and movable between an open position and a closed position;

a plurality of secondary containers; and a plurality of secondary container lids;

wherein each of the plurality of secondary containers and each of the plurality of secondary container lids are configured to allow each of the secondary container lids to be interchangeably connected to each of the plurality of secondary containers, the plurality of secondary container lids selectively attached to an upper portion of the plurality of secondary containers by the first coupling mechanism;

wherein a base of the primary container and a base of each of the plurality of secondary containers is configured to be interchangeably connected to an upper portion of each of the plurality of secondary container lids;

wherein a second type of coupling mechanism is used to connect the upper portion of each of the plurality of secondary container lids to the base of the primary container and the same type of second coupling mechanism is used to attach each of the plurality of secondary container lids to the base of each of the plurality of secondary containers, the second type of coupling mechanism being different than the first type of coupling mechanism;

wherein the primary container lid is not configured to be connected to the secondary containers; and wherein the secondary container lids are not configured to be connected to the upper portion of the primary container.

12. The stackable container system as in claim 11, wherein the base of the primary container and the upper portion of each of the plurality of secondary container lids are configured to be interchangeably connected with a bayonet-type mount for interlocking and connecting each of the plurality of secondary container lids and the primary container; and wherein the base of each of the plurality of secondary containers and the upper portion of each of the plurality of secondary container lids are configured to be interchangeably connected with a bayonet-type mount for interlocking and connecting each of the plurality of secondary container lids and each of the plurality of secondary containers.

13. The stackable container system as in claim 11, wherein the upper portion of each of the plurality of secondary container lids includes a flange that is configured to be disposed in a receiving portion disposed in the base of the primary container and in the base of each of the plurality of secondary containers.

14. The stackable container system as in claim 11, wherein the each of the plurality of secondary containers is selectively sealable with each of the plurality of secondary container lids independently from the primary container.

15. The stackable container system as in claim 11, wherein an upper portion of the primary container has a first diameter, the base of the primary container has a second diameter that is smaller than the first diameter;

wherein an upper portion of each of the plurality of secondary containers has a diameter that is equal to or substantially equal to a diameter of a lower portion each of the plurality of secondary containers; and wherein the diameter of the upper portion and lower portion of each of the plurality of secondary containers is equal to or substantially equal to the second diameter of the primary container.

16. The stackable container system as in claim 11, wherein a threaded-type connection is used to couple the primary container lid to the primary container;

wherein a threaded-type connection is used to couple each of the plurality of secondary container lids to each of the plurality of secondary containers; and wherein a bayonet-type connection is used to connect each of the plurality of secondary container lids to the base of the primary container and the base of each of the plurality of secondary containers.

17. The stackable container system as in claim 11, further comprising a tray that is selectively attachable to each of the plurality of secondary container lids, each of the plurality of secondary container lids being connectable to each of the plurality of secondary containers if the tray is attached to one of the plurality of the secondary container lids.

18. The stackable container system as in claim 11, wherein the first coupling mechanism is a threaded-type connection; and wherein the second type of coupling mechanism is a bayonet-type connection.

19. The stackable primary container system as in claim 11, further comprising a tray and a tray coupling mechanism disposed in an upper, inner portion of each of the plurality of secondary container lids, the tray selectively coupled to the tray coupling mechanism.

20. The stackable primary container system as in claim 19, wherein the tray is selectively coupled to any tray coupling mechanism in each of the plurality of secondary container lids; and wherein each of the plurality of secondary container lids can be selectively coupled to each of the plurality of secondary container lids.

* * * * *

UNITED STATES PATENT AND TRADEMARK OFFICE

CERTIFICATE OF CORRECTION

PATENT NO. : 9,216,843 B2
APPLICATION NO. : 14/297433
DATED : December 22, 2015
INVENTOR(S) : Sorensen et al.

It is certified that error appears in the above-identified patent and that said Letters Patent is hereby corrected as shown below:

Specification

In Column 11, Lines 3-4, delete "protrusion 44, 68" and insert -- protrusion 46, 68 --, therefor.

In Column 11, Line 31, delete "cneeetral divider" and insert -- central divider --, therefor.

Signed and Sealed this
Twenty-second Day of March, 2016

Michelle K. Lee

Michelle K. Lee
*Director of the United States Patent and Trademark Office*